United States Patent [19]

Matsumoto

[11] Patent Number: 4,838,058

[45] Date of Patent: Jun. 13, 1989

[54] CARD LOCK

[75] Inventor: Haruo Matsumoto, Amagasaki, Japan

[73] Assignee: Matsumoto Metal Mfg. Co., Ltd., Hyogo, Japan

[21] Appl. No.: 70,717

[22] Filed: Jul. 7, 1987

[30] Foreign Application Priority Data

Jul. 10, 1986 [JP] Japan ..... 61-105950[U]
Dec. 20, 1986 [JP] Japan ..... 61-196022[U]

[51] Int. Cl.[4] ..... E05B 25/00

[52] U.S. Cl. ..... 70/355; 70/384; 70/387

[58] Field of Search ..... 70/348, 349, 353, 354, 70/355, 339, 421, 387, 382–385

[56] References Cited

U.S. PATENT DOCUMENTS

| | | | |
|---|---|---|---|
| 619,143 | 2/1899 | Cushing | 70/387 X |
| 1,325,622 | 12/1919 | Coseglia | 70/387 X |
| 1,367,104 | 2/1921 | Snyder | 70/387 X |
| 1,887,094 | 11/1932 | Haviland | 70/353 |
| 2,524,696 | 10/1950 | Ellis | 70/355 X |
| 2,750,787 | 6/1956 | Capdevila | 70/355 X |
| 3,001,392 | 9/1961 | Brewington | 70/355 X |
| 3,520,161 | 7/1970 | Jacobi | 70/387 |
| 3,654,783 | 4/1972 | Sinclair | 70/349 |
| 3,834,197 | 9/1974 | Sedley | 70/387 X |
| 4,114,410 | 9/1978 | Astier | 70/355 X |
| 4,409,806 | 10/1983 | Propst | 70/354 X |
| 4,644,766 | 2/1987 | Lovell | 70/354 X |
| 4,735,068 | 4/1988 | Shimoi et al. | 70/349 |
| 4,777,815 | 10/1988 | Lovell et al. | 70/384 X |

FOREIGN PATENT DOCUMENTS

| | | | |
|---|---|---|---|
| 855330 | 5/1940 | France | 70/349 |

*Primary Examiner*—Robert L. Wolfe
*Assistant Examiner*—Suzanne L. Dino
*Attorney, Agent, or Firm*—Wenderoth, Lind & Ponack

[57] ABSTRACT

Engaging pieces of plates pivotally mounted in a lock box are adapted to engage holes or cutouts formed in a slide member slidable between its locked and unlocked positions. When a right card formed with holes and cutouts in right positions is inserted into a card slot, the engaging pieces in engagement with the holes or cutouts are all pushed down by the card, pivot or pins and are disengaged out of the holes, while the engaging pieces out of engagement are not pushed by the card owing to the cutouts or holes in the card. Thus the slide member freed from the restraint by the engaging pieces can be slid to its unlocked position to open the lock. When a wrong card is inserted, the engaging pieces out of engagement with the slide member will be pushed by the card and engage the slide member, restraining it from moving. Thus the lock cannot be opened.

2 Claims, 5 Drawing Sheets

CARD LOCK

BACKGROUND OF THE INVENTION

The present invention relates to a card lock adapted to be opened by use of a card of plastic or the like formed with cutouts and holes.

As a keyless lock, there is known a pushbutton lock which comprises a box provided with a plurality of pushbuttons, a plurality of pieces for engagement adapted to be operated by the pushbuttons, a slide member formed with a plurality of holes for removably receiving the engaging pieces, and a locking mechanism directly or indirectly associated with the slide member. By pressing predetermined pushbuttons of this pushbutton lock, the engaging pieces engaged in the holes of the slide member are disengaged, thus allowing the slide member to move and the lock to be opened.

With this type of a pushbutton lock, since only the predetermined buttons are pushed every time the lock is opened, the color of those buttons on their top changes more quickly and distinctively than that of the other buttons. Thus, there arises a fear that a person might easily find the combination of numbers.

SUMMARY OF THE INVENTION

An object of the present invention is to provide a lock which obviates the abovesaid shortcomings and which can be easily opened.

In accordance with the present invention, there is provided a lock comprising a lock box formed with a card slot, a plurality of engaging pieces pivotally mounted in the lock box, a slide member slidably mounted in the lock box, some of the engaging pieces being adapted to engage engaging portions formed in the slide member to restrain the slide member when the lock is in its locked position, and the slide member being freed from the restraint by the engaging pieces only when a right card is inserted.

When the lock is in its locked position, some of the engaging pieces or plates are engaged in predetermined holes in the slide member mounted in the lock box, restraining the slide member from moving and thus locking the locking mechanism associated therewith.

When the right card is inserted into the card slot, the engaging plates are pushed down by the card owing to the holes or cutouts formed in the card and thus disengaged from the holes in the slide member. Now the lock can be opened.

If a wrong card is inserted, not only is it impossible to remove the engaging plates out of engagement with the holes in the slide member, but also some of the engaging plates will be newly put into engagement with the slide member. Thus the lock cannot be opened.

The lock according to the present invention can be opened just by inserting a card formed with holes and cutouts of different sizes into the slot. Thus it can be opened far more easily than a conventional pushbutton lock. Further, one does not have to worry about the combination of numbers being detected by any third person, and also locking and unlocking can be easily done even in the dark.

Other features and objects of the present invention will become apparent from the following description taken with reference to the accompanying drawings, in which:

DETAILED DESCRIPTION OF THE PREFERRED EMBODIMENTS

Figure 1:
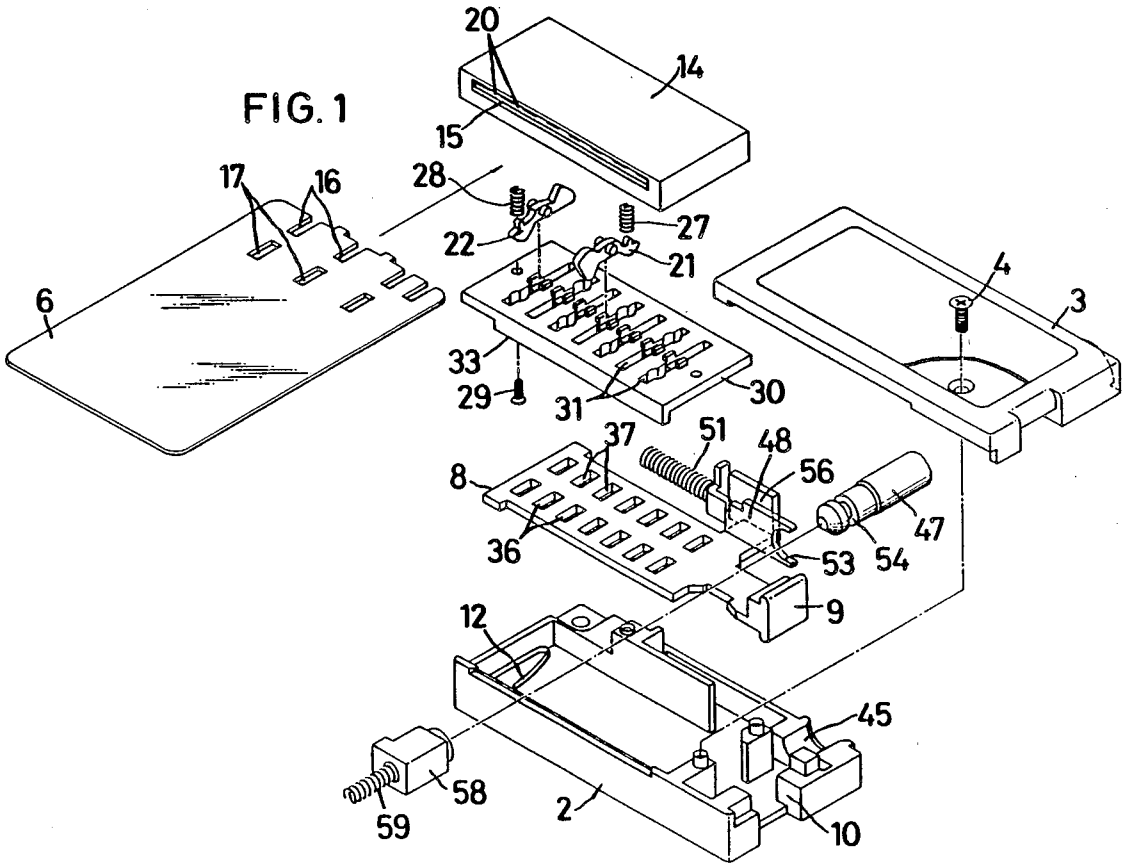
FIG. 1 is an exploded perspective view of the first embodiment of the card lock according to the present invention.

First referring to FIGS. 1–7 in which the first embodiment of the present invention is shown, numeral 1 (FIG. 3) generally designates a rectangular lock box comprising a body 2 and a cover 3 coupled together by means of a plurality of screws 4 (FIG. 1).

The lock box serves to contain the locking member, bottom cover, slide member, and engaging pieces which will be described below. Instead of providing a lock box, the space for incorporating these members may be provided in the equipment or installation to be locked.

The box 1 is formed with a slot 5 for insertion of a card 6 made of plastic or the like. A slide member 8 is longitudinally slidably mounted in the body 2 on its bottom and has a push-in portion 9 at one end thereof protruding through a cutout 10 formed in the body 2 at one end thereof.

A spring 12 is provided in the body 2 to bias the slide member 8 toward the cutout 10 in the body 2.

A rectangular locking member 14 is mounted over the slide member 8. It is formed in the upper part of its one long side with a slot 15 for receiving a card, said slot having one end opened so as to face the card slot 5 of the lock box 1 and the other end closed.

Figure 7:
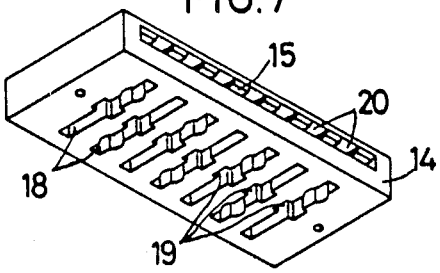
FIG. 7 is a perspective view of the locking member.

In FIG. 7, numeral 18 indicates a plurality of elongated holes cut through the bottom wall of the locking member 14 so as to communicate with the card slot 15 and extend parallel with the short side of the locking member. Each hole 18 is formed with opposite cutouts 19 at both sides of its mid-portion.

A plurality of grooves 20 are formed in the upper wall of the card slot 15 so that each groove will be aligned with the respective hole 18.

Two kinds of engaging plates 21, 22 are loosely mounted in the holes 18. The plates 21, 22 are provided with pins 23, 24 (FIGS. 3 and 5), respectively, which are engaged in the cutouts 19 so that the plates 21, 22 can pivot on the pins 23, 24.

The plates 21, 22 are adapted to be on acted by springs on their rear ends 25, 26 (FIGS. 4 and 5), respectively. The plates 21, 22 are mounted in such a manner that their spring receiving portions 25, 26 will be alternately positioned at opposite sides. Springs 27, 28 are mounted between the spring receiving portions 25, 26 and spring receiving pieces in the mounting holes 18.

A bottom cover 30 (FIG. 1) is coupled to the bottom of the locking member 14 by means of screws 29 and it has a plurality of holes 31 each aligned with the respective hole 18 in the locking member 14.

The bottom cover 30 is provided with guide members 33 extending downwardly from its long side edges at its bottom so as to be in contact with the long sides of the slide member 8 to guide it. The slide member 8 is provided at its rear both sides with stoppers 34 (FIG. 2), and is formed with a plurality of elongated holes 36, 37 arranged in two rows and adapted to be aligned with both ends of the holes 31 of the bottom cover 30 when the stoppers 34 urged by a spring 12 abut the guides 33.

Figure 3:
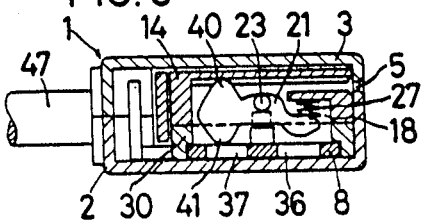
FIGS. 3 to 6 are vertical sectional side views of the lock box showing in what condition the lock is.
Figure 4:
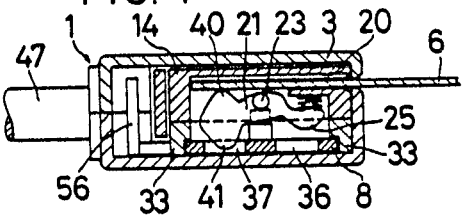

As shown in FIGS. 3 and 4, each engaging plate 21 is provided with upper and lower projections 40, 41 at the end opposite to the spring receiving portion 25. As is apparent from FIG. 3, when no card is in the slot 15, the projection 40 sticks out into the groove 20 through the card slot 15, urged by the spring 27, while the projection 41 is out of the hole 37 in the slide member 8.

When a card, 6 is inserted, the projection 40 will be pushed down by the portion of the card having no cutout, and the projection 41 will be lowered to engage in the hole 37 of the slide member 8, as shown in FIG. 4.

Figure 5:
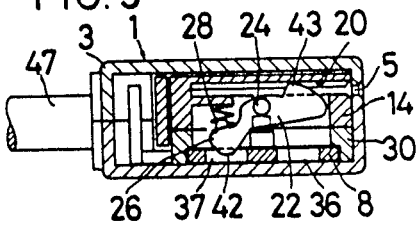

Each engaging plate 22 is formed with a projection 42 below the spring receiving portion 26, and with a projection 43 at the upper part of its opposite end. As shown in FIG. 5, when no card is in the slot 15 the projection 43 sticks out into the groove 20 through the card slot 15 whereas the projection 42 is engaged in the hole 37.

Figure 6:
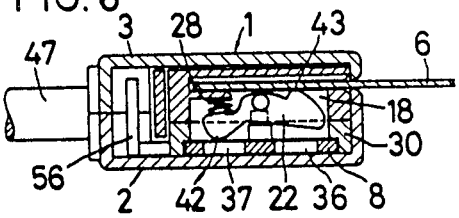

When the projection 43 is pushed down by a holeless portion of the card 6 inserted as shown in FIG. 6, the other projection 42 will get out of the hole 37 in the slide member 8.

The plates 21, 22 mounted in the opposite direction to the one shown in FIGS. 3 to 6 are operated in the same manner as described above.

The above-described embodiment is applicable to what is called a wire lock for use with, for example, a bicycle. A hole 45 is formed in one end of the lock box 1 so as to extend perpendicular to the direction of sliding movement of the slide member 8. A lock bar 47 is adapted to be received in the hole 45 and secured to one end of a wire 46 (FIG. 2) having its other end connected to the other end of the lock box 1.

A locking plate 48 is mounted in the body 2 so as to be slidable along a guide groove 50 and is normally biased by a spring 51 toward the insert hole 45 so that its leading edge 53 will engage an annular groove 54 formed in the bar 47.

The slide member 8 is integrally provided with a push plate 56 which functions to push back the locking plate 48 to its unlocked position against the bias of the spring 51.

A pusher 58 provided deep in the insert hole 45 is normally biased toward the opening of the hole 45 by a spring 59 to push back the bar 47 inserted therein to the unlocked direction.

Next it will be described how the lock embodying this invention is operated.

Figure 2:
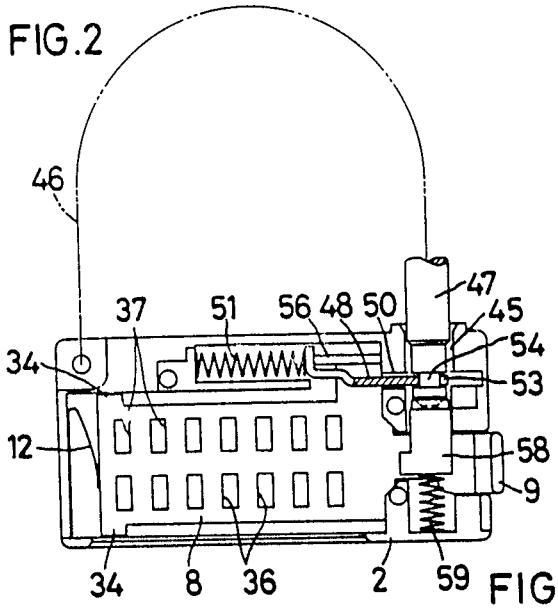
FIG. 2 is a plan view of the same with the cover of the lock box removed.

FIG. 2 shows the lock in its locked position, wherein the bar 47 is received in the insert hole 45 of the lock box 1 with the locking plate 48 engaging in its annular groove 54 so as not to come off.

In this state, the projections 41 of the plates 21 in the lock box 1 are out of engagement with the holes 37 in the slide member 8, as shown in FIG. 3, whereas the projections 42 of the plates 22 are in engagement with the holes 37 in the slide member 8, as shown in FIG. 5.

Thus, the slide member 8 is locked in the position shown in FIG. 2 so that it will not move even when its push-in portion 9 is pushed, and thus the lock cannot be opened.

If the projections 40 of the plates 21 should be pushed by the card 6 inserted as shown in FIG. 4, the projections 41 will engage into the holes 37 in the slide member 8, restraining it from moving. Therefore, even if all the projections 42 of the plates 22 should be cleared from the holes 37 as shown in FIG. 6, the lock would not still be able to be opened. This means that this card 6 is bogus.

When a card 6 is inserted, if cutouts 16 (FIG. 1) in the card 6 fit the projections 40 of the plates 21, the latter will remain as they are shown in FIG. 3. If the projections 43 of the plate 22 are pushed by the uncut portion of the card 6 as shown in FIG. 6, the projections 42 will be out of engagement with the holes 37.

At this state, the slide member 8 is free to move. When the push-in portion 9 is pushed against the bias of the spring 12 to move the slide member 8 to the lefthand side in FIG. 2, its push plate 56 will move the locking plate 48 to the lefthand side against the bias of the spring 51, releasing the engagement with the bar 47. The bar will be pushed out of the insert hole 45 with the advance of the pusher 58 biased by the spring 59.

In this unlocked position, the projections 42 of the plates 22 remain in contact with the slide member 8 at the holeless portion even after the card 6 is pulled out.

With the lock in its opened position and with the card 6 pulled out of the slot, when the bar 47 is thrust into the hole 45, it advances pushing the locking plate 48 to the lefthand side with its tapered tip, and pushing down the pusher 58 against the bias of the spring 59. When the annular groove 54 of the bar 47 is lowered to the level of the locking plate 48, the latter will be moved back by the resilience of the spring 51 into engagement with the annular groove 54.

When the locking plate 48 is brought to its locked position, the projections 42 of the plates 22 are engaged in the holes 37 in the slide member 8 to lock the slide member in position.

In FIGS. 3 to 6, the projections 41, 42 are adapted to be engaged in the holes 37 at the lefthand side. But the plates 21, 22 may be mounted in the mounting hole 18 in the opposite position to above so that the projections 41, 42 will be engaged in the righthand holes 36. This is why the mounting holes 18 are arranged in the alternate directions as shown in FIG. 7.

A vast number of combinations are possible by changing the manner of arranging the plates 21, 22 in the holes 18 in the position and direction.

Figure 8:
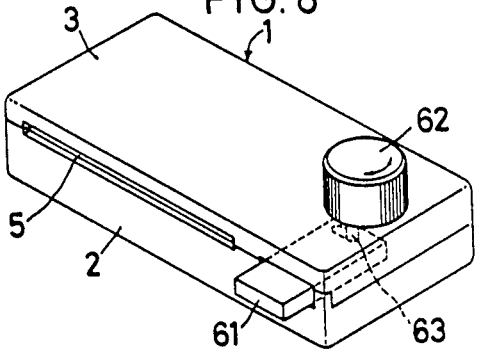
FIG. 8 is a perspective view of the lock in which the first embodiment is applied to a cross bar lock.
Figure 9:
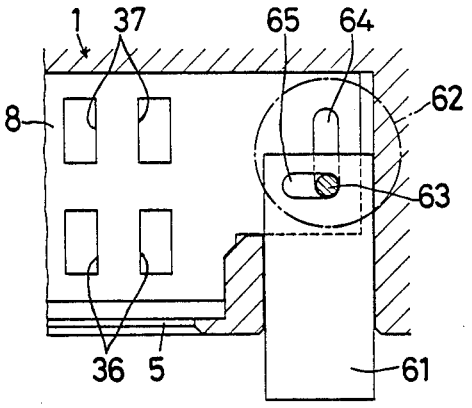
FIGS. 9 and 10 are partially cutaway enlarged transverse sectional plan views of a portion of the lock shown in FIG. 8 illustrating how it is operated.
Figure 10:
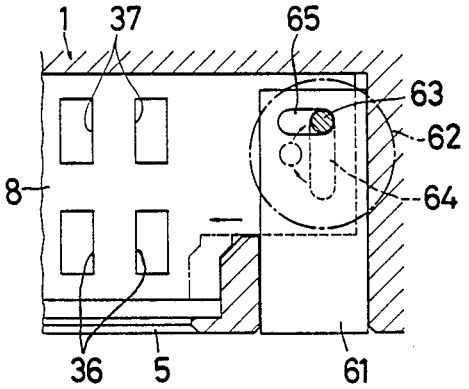

Besides the wire lock as described, this invention can be applied to a crossbar lock as shown in FIGS. 8 to 10.

In this case, the lock box 1 is provided in one end with a retractable crossbar 61 and with a knob 62 rotatably mounted on the lock box. An eccentric pin 63 is provided on the bottom of the knob 62.

The eccentric pin 63 extends through an arcuate hole into the lock box 1 to engage in an elongated slit 64 (FIG. 9) formed in the end of the slide member 8 and another elongated slit 65 formed in a crossbar 61.

The slit 64 extends in a direction perpendicular to the movement of the slide member 8, while the slit 65 does in a direction perpendicular to the movement of the crossbar 61. Thus, the slide member 8 is fixed when it is in a locked position, restraining the knob 62 from turning.

When a right card is inserted into the card slot 5, the slide member 8 becomes slidably movable in the same manner as in the previous embodiment, thus allowing the knob 62 to be turned in the direction of arrows in FIG. 10 to retract the crossbar 61 as shown in the same figure to open the lock.

In the second embodiment as illustrated in FIGS. 11 to 16, the rectangular lock box 1 is formed by coupling the body 2 and the cover 3 together by means of screws. The card slot 5 (FIG. 13) for receiving the card 6 is formed in one side thereof.

If this embodiment is applied to a wire lock, the lock box 1 should be provided with the insert hole 45 for the bar 47, and in its body 2 with the locking plate 48 so as to be slidable along the guide groove 50, and with the spring 51 for biasing the locking plate 48 toward the insert hole 45 so that its end portion 53 (FIG. 11) will engage the peripheral groove 54 of the lock bar 47.

A slide member 68 is mounted in the body 2 so as to be longitudinally slidable, and has its push-in portion 69 provided at one end thereof and protruding out of the body 2 through the cutout 10 formed in one end thereof.

The slide member 68 is integrally formed with the push plate 56 for pushing the locking plate 48 back against the bias of the spring 51.

The pusher 58 provided deep in the insert hole 45 of the body 2 is biased by the spring 59 toward the opening of the insert hole 45 to push the lock bar 47 back to its unlocked position.

Figure 11:
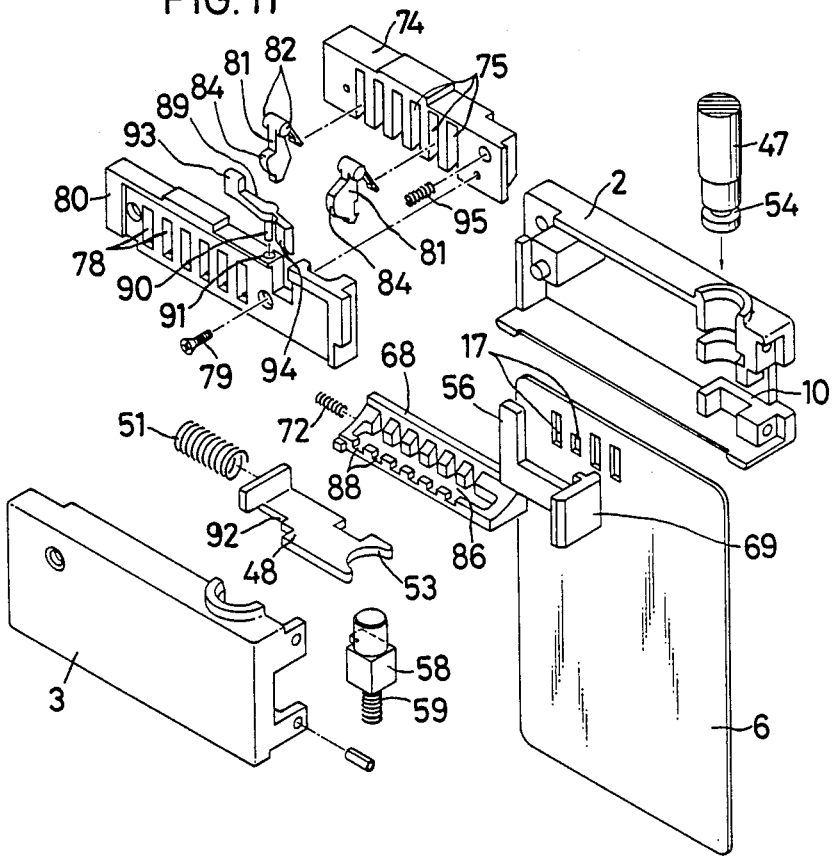
FIG. 11 is an exploded perspective view of the second embodiment.
Figure 12:
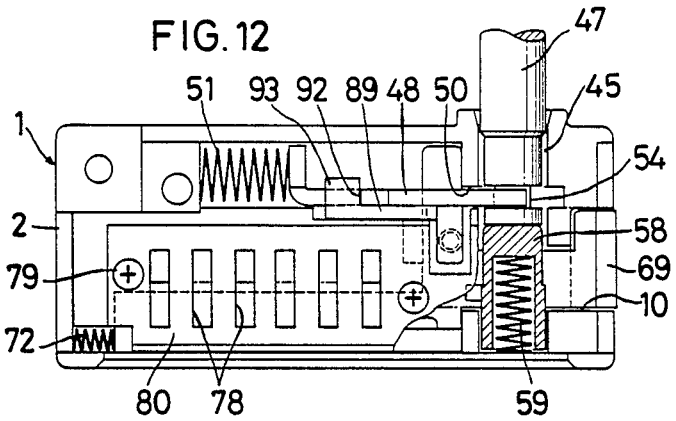
FIG. 12 is a plan view of the same with the cover of the lock box removed.

A spring 72 shown in FIGS. 11 and 12 is provided in the body 2 in order to push the slide member 68 toward the cutout 10 formed in the body 2.

Numeral 74 designates a locking member disposed adjacent the slide member 68 and formed with a plurality of elongated cutouts 75. A cover 80 is mounted on the locking member 74 and fastened thereto by screws 79. The card slot 15 (FIG. 13) is formed between the cover 80 and the cover 3 of the lock box 1.

Figure 13:
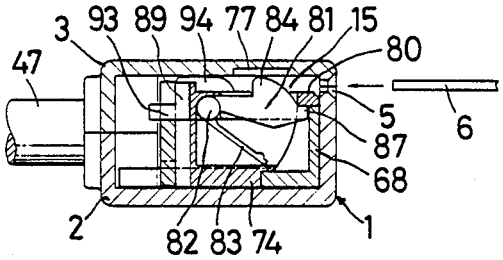
FIG. 13 is a vertical sectional side view of the same.
Figure 14A:
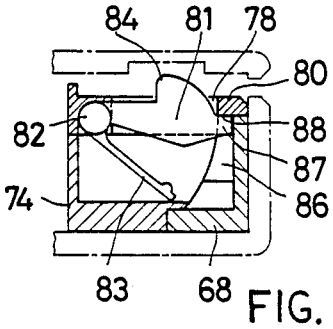
FIGS. 14(*a*)–14(*d*) and 15(*a*)–15(*d*), are vertical sectional side views of the same showing how the lock mechanism works.
Figure 14B:
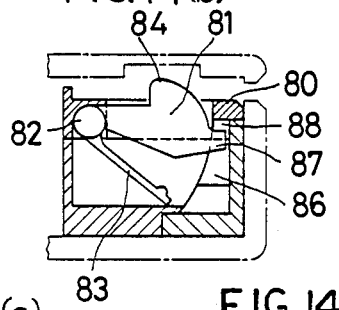
Figure 14C:
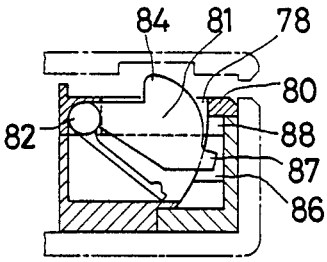
Figure 14D:
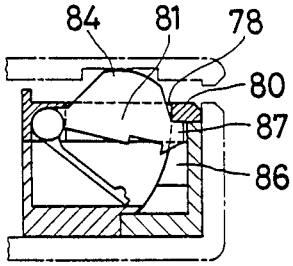
Figure 15A:
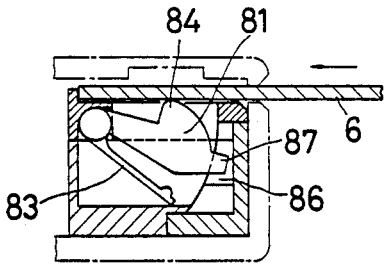
Figure 15B:
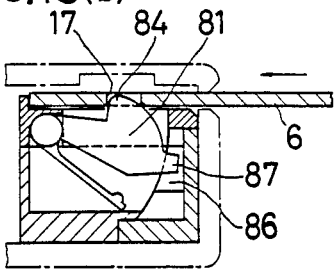
Figure 15C:
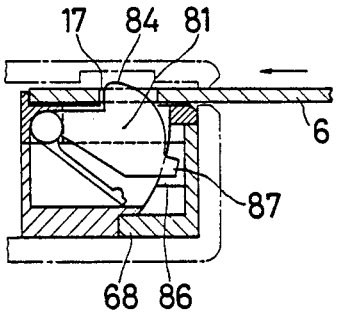
Figure 15D:
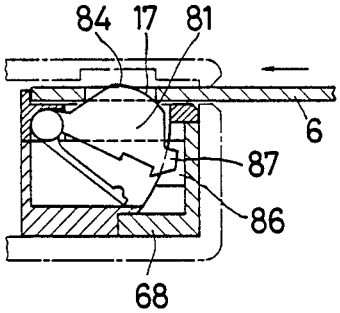

The cover 80 is formed with a plurality of elongated mounting holes 78 as shown in FIG. 12. In the back of the cover 3 is formed a plurality of grooves 77 facing the mounting holes 78 as shown in FIG. 13.

A plurality of engaging plates 81 are loosely mounted in the mounting holes 78. Each plate 81 is provided at both sides of its rear end with pins 82 engaging the rear end of the respective mounting hole 78 so as to pivot on the pins 82. A spring 83 (FIG. 13) integral with the plate 81 has its tip put in contact with the bottom of each cutout 75 of the locking member 74 so as to cause the plate 81 to protrude above the cover 80.

At the tip of the plates 81 is formed a projection 87 adapted to engage in and disengage from a guide groove 86 (FIG. 14) extending through the slide member 68. At one side of the guide groove 86 are formed a plurality of cutouts 88 in which the projections 87 engage. (FIG. 11)

Numeral 89 in FIGS. 11 and 12 designates another engaging piece mounted on the upper side of the cover 80. The engaging piece 89 is adapted to pivot on a pin 90 provided at one side of its mid-portion and inserted in a hole 91 formed in the upper surface of the cover 80. The engaging piece 89 is further provided at its one end with a projection 93 adapted to releasably engage a stepped portion 92 of the locking plate 48 and at the other end with a spring receiving portion 94. A spring 95 is mounted between the portion 94 and the locking member 74 to normally urge the projection 93 against the stepped portion 92.

When the projection 93 is in engagement with the stepped portion 92, the spring receiving portion 94 protrudes into the card slot 15.

Next, it will be described how the second embodiment operates. FIG. 12 shows the lock in its locked position with its lock bar 47 inserted in the insert hole 45 and the locking plate 48 engaging in the annular groove 54 of the bar 47 so that the bar cannot get out of the hole 45.

The projection 93 of the engaging piece 89 engages the stepped portion 92 of the locking plate 48 to restrain the locking plate from moving back.

The engaging plate 81 is biased by the spring 83 so that its projection 84 sticks out of the mounting holes 78 of the cover 80 into the card slot 15 as shown in FIGS. 13 and 14. The plates 81 are provided in different shapes which are different in the circumferential length, the height of the projection 84 and/or the circumferential location of the projection 87.

Although the projections 84 shown in FIGS. 14 (*a*), (*b*) and (*c*) are all of the same height, in FIG. 14(*a*) the projection 87 is received in the cutout 88, and in FIG. 14(*b*) the upper half of the projection 87 engages in the lower half of the cutout 88, whereas in FIG. 14(*c*) the projection 87 is in the groove 86. The plate shown in FIG. 14(*d*) has the highest projection 84, and has its projection 87 in engagement with the cutout 88.

Thus, the slide member 68 is locked in the position shown in FIG. 12 and is not movable even if its push-in portion 69 is pushed.

If a right card 6 is inserted into the lock in its locked position through its slot 5, the projection 84 shown in FIG. 15(*a*) is pushed down by the holeless portion of the card 6 to bring the projection 87 into the guide groove 86, and the projection 84 in FIG. 15(*b*) is pushed down a little by the edge of a relatively small hole 17 in the card 6 to put the projection 87 into the guide groove 86. In FIG. 15(*c*), since a hole 17 in the card is larger than the projection 84, the plate 81 stays with its projection 87 left in the guide groove 86. In FIG. 15(*d*), since the projection 84 is still larger than the hole 17, it is slightly pushed down by the edge of the hole 17, bringing the projection 87 into the guide groove 86.

On the other hand, the card 6 pushes down, with its end portion, the upper part of the spring receiving portion 94 (FIG. 13), disengaging the projection 93 of he engaging piece 89 from the stepped portion 92 of the locking plate 48.

In this state, the slide member 68 now free to move is slid to the lefthand side in FIG. 12 by pushing the push-in portion 69 against the bias of the spring 72. Its push plate 56 moves the locking plate 48 to the lefthand side against the bias of the spring 51, disengaging the locking plate 48 from the annular grove 54 of the bar 47 and thus allowing the bar to be pushed out of the insert hole 45 by the pusher 58 biased by the spring 59.

While the lock is in this unlocked position, the projection 84 of the plate 81 will remain in contact with the side edge of the guide groove 86 of the slide member 68 even after the card 6 has been pulled out, so that the slide member is still movable.

With the lock opened as described above and the card 6 pulled out, when the bar 47 is pushed into the insert hole 45, while thrusting with its tapered end the locking plate 48 to the lefthand side against the bias of the spring 51 and pushing down the pusher 58 against the bias of the spring 59 until its annular groove 54 is lowered to the same level as the locking plate 48, the latter engages the annular groove 54 of the bar 47 with the resilience of the spring 51.

When the locking plate 48 is brought to the locked position, the plates 81 for engagement get back to their original position as shown in FIG. 14 to lock the slide member 68 in position.

Figure 16:
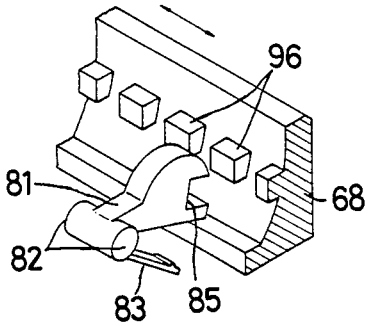
FIG. 16 is a partially cutaway perspective view of another example of the combination of the engaging plate and the slide member.

FIG. 16 shows another example of the engaging plate 81, wherein a recess 85 is provided in place of the projection 87, and a plurality of projections 96 are arranged in a line on the slide member 68 instead of forming the guide groove 86. This arrangement works in completely the same manner as with the combination of the projections 87 and the guide groove 86.

Further, this embodiment can be applied to a crossbar lock as shown in FIGS. 8 to 10.

Even if the card 6 is made thinner, depending upon the depth of the grooves 20 formed in the card slot 15 in the first embodiment or that of the grooves 77 also formed in the card slot 15 in the second embodiment, the plates 21, 22 or 81 for engagement can surely engage the card 6.

What is claimed is:

1. A card-operated lock comprising:

a lock box;

a card slot in said lock box for receiving a card;

a locking member mounted in said lock box;

a slot in said locking member and aligned with said card slot of said lock box for receiving a card;

a plurality of holes in said bottom cover;

a plurality of first and second engaging pieces pivotably mounted between said locking member and said bottom cover and received in said plurality of holes;

a slide member slidably mounted in said lock box for locking said lock;

a plurality of engaging holes in said slide member;

said first ones of said plurality of first and second engaging pieces having means for engaging ones of said plurality of engaging holes of said slide member for restraining said slide member for locking said lock, said engaging means of said first ones of said engaging pieces being normally engaged with said ones of said plurality of engaging holes, and disengaging from said ones of said plurality of engaging holes of said slide member only when a right card is inserted into said slots and pivots said first engaging pieces; and said second ones of said plurality of first and second engaging pieces having means for engaging ones of said plurality of engaging holes of said slide member for restraining said sliding member, said engaging means of said second ones of said engaging pieces being normally disengaged from said ones of said plurality of engaging holes, and engaging said ones of said plurality of engaging holes of said slide member only when a wrong card is inserted into said slots and pivots said second engaging pieces.

2. A card-operated lock comprising:

a lock box;

a card slot in said lock box for receiving a card;

a locking member mounted in said lock box;

a slot in said locking member and aligned with said card slot of said lock box for receiving a card;

a plurality of holes in said bottom cover;

a plurality of first and second engaging pieces pivotably mounted between said locking member and said bottom cover and received in said plurality of holes;

a slide member slidably mounted in said lock box for locking said lock;

a guide groove in said slide member and extending in the direction of sliding movement of said slide member;

a plurality of engaging holes in said slide member adjacent and along said guide groove;

said first ones of said plurality of first and second engaging pieces having projection means for engaging ones of said plurality of engaging holes for restraining said slide member for locking said lock, and said projection means of said first ones of said engaging pieces being normally engaged with said ones of said plurality of engaging holes, and disengaging from said ones of said plurality of engaging holes and moving into said guide groove only when a right card is inserted into said slots and pivots said first engaging pieces; and said second ones of said plurality of first and second engaging pieces having projection means for engaging ones of said plurality of engaging holes for restraining said slide member, and said projection means of said second ones of said engaging pieces being normally disengaged from said ones of said engaging holes, and engaging said ones of said engaging holes of said slide member only when a wrong card is inserted into said slots and pivots said second engaging pieces.

* * * * *